United States Patent [19]

Fillmore, Jr. et al.

[11] 3,987,648

[45] Oct. 26, 1976

[54] DRIVE FOR FULL WIDTH SHOGGING MOVEMENT OF THE THREAD GUIDE BAR ON RASCHEL KNITTING MACHINES

[75] Inventors: Malcolm Graham Fillmore, Jr., Martinsville; Roy Lee Turner, Woolwine, both of Va.

[73] Assignee: J. P. Stevens & Co., Inc., New York, N.Y.

[22] Filed: July 21, 1975

[21] Appl. No.: 597,474

[52] U.S. Cl. ..... 66/207

[51] Int. Cl.[2] ..... D04B 23/00

[58] Field of Search ..... 66/86 E, 86 B

[56] References Cited

UNITED STATES PATENTS

| | | | |
|---|---|---|---|
| 1,706,426 | 3/1929 | Vorck | 66/84 |
| 1,812,700 | 6/1931 | Johnson | 66/84 |
| 2,508,209 | 5/1950 | Amidon | 66/86 B |
| 3,568,470 | 3/1971 | Kohl | 66/86 E |

*Primary Examiner*—Ronald Feldbaum
*Attorney, Agent, or Firm*—Robert Ames Norton; Michael T. Frimer; Saul Leitner

[57] ABSTRACT

A drive for a guide bar on a Raschel knitting machine to permit shogging across the full width of narrow fabrics. The drive is by cam, double lever linkage with adjustment slots and pins at at least two points on the levers. For maximum fabric width, for example significantly wider than 1.25 inches, there is also a minor modification of the guide bar supports themselves. These involve pins, and the pins are enough longer so that the bar can move a greater distance without interfering or striking other portions of the knitting machine.

2 Claims, 3 Drawing Figures

DRIVE FOR FULL WIDTH SHOGGING MOVEMENT OF THE THREAD GUIDE BAR ON RASCHEL KNITTING MACHINES

BACKGROUND OF THE INVENTION

Modifications of the standard guide bar motion for Raschel warp knitting machines in which the thread guide bar has forward and back motions and two horizontal motions for shogging have been used for making narrow fabrics in which it is desired to shog the full width of the fabric. This can be done for sufficiently narrow fabrics with ordinary pattern chains or wheels but there is a very definite limit to the width of the fabric. With known forms of pattern chains or pattern wheels or similar mechanisms for moving thread guide bars, the maximum width of fabric which can be produced with full width shogging is not significantly greater than 0.5 inch. While this makes possible knitting these very narrow fabrics or tapes on Raschel machines, there is a demand for a different drive which could accommodate wider fabrics. It is with drive mechanism for accomplishing this result that the present invention deals.

SUMMARY OF THE INVENTION

In a broader aspect of the invention the guide bar is pushed in a sideways direction for shogging by a push rod which is pivoted in a lever with a fixed pivot at the other end and linkage connection to a second pivoted lever with a pivot in the center or, more precisely, between the ends. One end of this lever is connected by a linkage to a cam follower which is driven by a cam moving in synchronism with the knitting machine drive. Preferably, provisions for adjusting stroke are made in the form of slots in the first lever and in at least one of the two portions of the second lever, the connecting linkage or bar being pivoted in these slots with the possibility of moving the pivots to various positions in the slots and locking them by screwing down. This form of movable pivot and slot is a well known machine element, and it is an advantage that pivot pins which can be moved in the slots and then locked by screwing are standard machine elements and require no special connections. When, as preferred, there is another slot with adjustable pin in the other portion of the lever pivoted near its center, this pivots another linkage or bar at the other end of which is a conventional cam follower which is driven by a cam from the knitting machine drive and in synchronism therewith. Preferably flat cams with cam grooves are used, in which case the cam follower is a suitable pin or roller, also a well known machine element. Other forms of cams may also be used, and in its broader aspects the present invention is not limited to any particular design of cam. All that is necessary is that the cam profile be suitable to produce the desired shogging movement of the thread guide bar or rather various adjustable shogging movements for different widths of narrow fabric.

The simple drive described above is very economical because it requires no change otherwise in a Raschel knitting machine. However, there is a limitation. While fabrics up to about three times the width which could be knit with pattern chains or pattern wheels of well known design can be knit, that is to say fabrics up to 1.25 inches can be knit, if it is desired to knit still wider fabrics a minor modification of the Raschel machine is needed because otherwise the thread guide would strike portions of the machine which constitutes the limit on width with the simple mechanism. In a more specific aspect such simple modification by having thread guide brackets with longer pins permit still wider fabrics because they keep the thread guide from striking other portions of the machine too soon. With the longer pins fabrics up to 2 inches and even somewhat more can be knit, and this further opens up the field of knit narrow fabrics for production on Raschel warp knitting machines. While theoretically there is no upper limit on stroke adjustment, the present invention is still concerned with what the trade refers to as a narrow fabric. Obviously, of course, if one shogged across a 6-, 8-, or 10-foot width, even the big improvement of the present invention would be unsatisfactory. Therefore, the present invention should be considered to be limited to narrow fabrics although extending the width of those narrow fabrics very substantially and opening up new fields.

The elements of a cam drive and parallelogram linkages are known mechanical elements and have actually been used in connection with a knitting machine, as described in the very old patent to Sumner, U.S. Pat. No. 539,558. In this patent there is described a knitting of mattresses with very thick laid-in weft threads. It is these thick weft threads that are moved across by the cam and linkages. This, of course, has nothing to do with the present invention, which moves a guide bar performing an entirely different function and being applicable to narrow fabrics only whereas the Sumner patent knitted wide mattresses. Incidentally, in the Sumner patent there is no suggestion of adjustability of stroke.

In the drawings, described in a subsequent section of the specification, there is illustrated a single thread guide which will shog the full width of a single narrow fabric. There can, of course, be several thread guides across the length of the Raschel machine so that a number of narrow fabrics can be knitted at the same time. If all of the fabrics are to be of the same width, all of the shogging guide bars can be driven by the cam and linkage which has been mentioned. It is, of course, theoretically possible to have different widths of the fabrics being knit at the same time but this would require separate drives for the different guide bars, which would multiply the cams and linkages, or at least the linkages, excessively. While such an operation is possible, it is definitely not preferred because of the much greater complexity and cost. If fabrics of different widths are to be knit, it is preferable to knit one width for a number of fabrics on the Raschel knitter and then if it is desired to use only a single knitter, shogging stroke can be readjusted for the next batch of different widths of narrow fabric. It is, of course, possible and sometimes desirable to have more than one Raschel knitter, each one knitting narrow fabrics of the same width.

The present invention is directed to a particular mechanism or rather a Raschel knitting machine incorporating the mechanism. The invention is not directed to the new result as such, for production of very narrow fabrics has, as has been set out above, been effected with ordinary known forms of patterns or pattern wheels. We have also developed a cam or pattern of unusual and novel form which is capable of producing the results of the present invention as far as fabric is concerned though by a mechanism different from that of the present invention and one which does not permit changing the width of fabric as has been described above. Such mechanisms involving no linkages with the adjustment features of the present invention are, of course, not included in the present invention although they may be capable of producing similar results in the final fabric.

DESCRIPTION OF THE PREFERRED EMBODIMENTS

Figure 1:
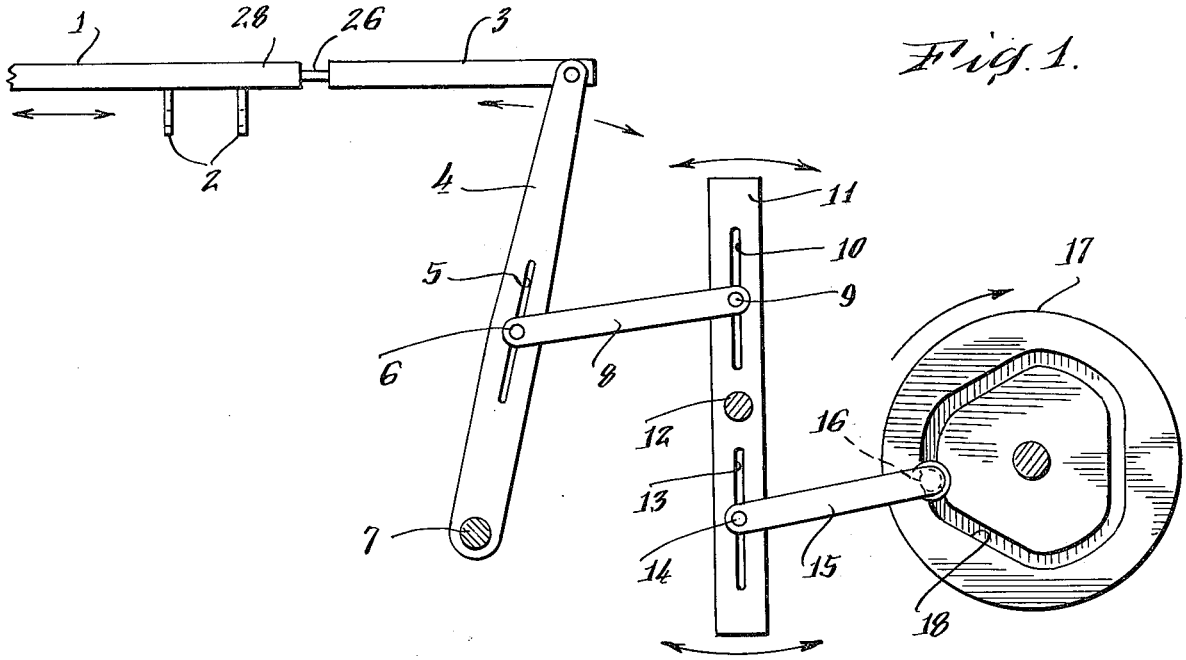
FIG. 1 is a diagrammatic elevation of a simple linkage with the end of the driving cam shown in plan view.

FIG. 1 is diagrammatic as the Raschel knitter is not changed in the slightest and therefore only the drive for the guide bar is shown. The bar itself is shown at 1 with two thread guides 2, though, of course, in an actual fabric there would be more thread guides. 3 is the push rod for the guide bar, which is pivoted at the end of a lever 4, the other end of which is pivoted on the pivot 7, which is attached to the knitting machine frame. Toward the middle of the lever 4 there is a slot 5 in which a lockable pin 6 forms a pivot for a link 8. The lockable pivot is of conventional design and is therefore shown diagrammatically. It can be moved in the slot 5 and then locked in position but still forming a pivot for a link 8. The other end of the link 8 is pivoted on a locking pivot 9 of the same design as 6 which moves in a slot 10 of a lever 11, which in turn is pivoted at or near its center on the pivot 12. In the lower portion of the lever 11 there is another slot 13 in which a locking pin pivot 14 can be moved. On this pivot is pivoted the link 15 at the other end of which is a roller or pin 10 acting as a cam follower. This pin projects into the groove 18 of the cam 16, which is driven in synchronism with the knitting machine by the main drive.

Motions of the levers and of the guide bar 1 are indicated by the double arrows. The provision of three slots in the two levers 4 and 11 permits a maximum of fine stroke adjustment and constitutes the preferred embodiment. However, if not as much adjustment is needed, one of the slots may be eliminated, for example slot 10, in which case, of course, the locking pivot 9 is a fixed pivot.

As has been described above, the particular design of cam is not that which distinguishes broadly the present invention from the prior art. Other known forms of cam and cam follower may be used but, as has been stated, the flat face with a groove is the preferred form.

Figure 2:
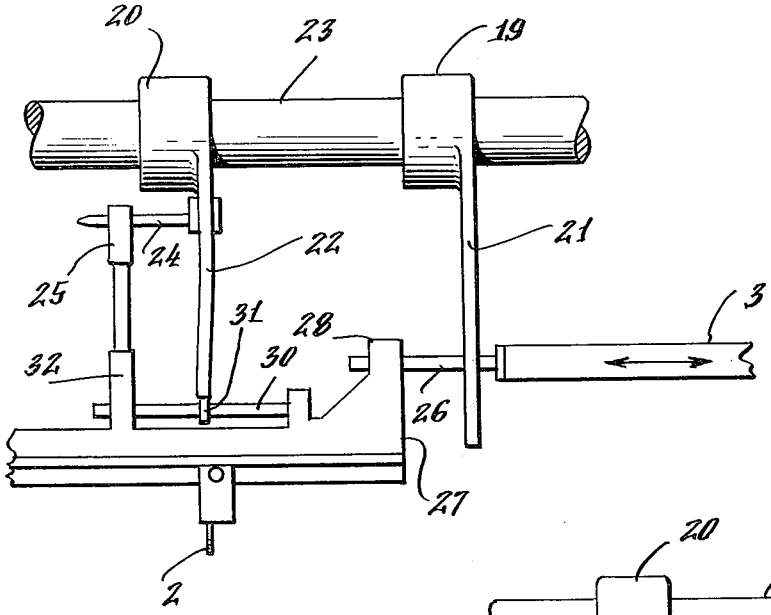
FIG. 2 is a diagrammatic detail of the support of thread guide brackets on an ordinary Raschel knitter.
Figure 3:
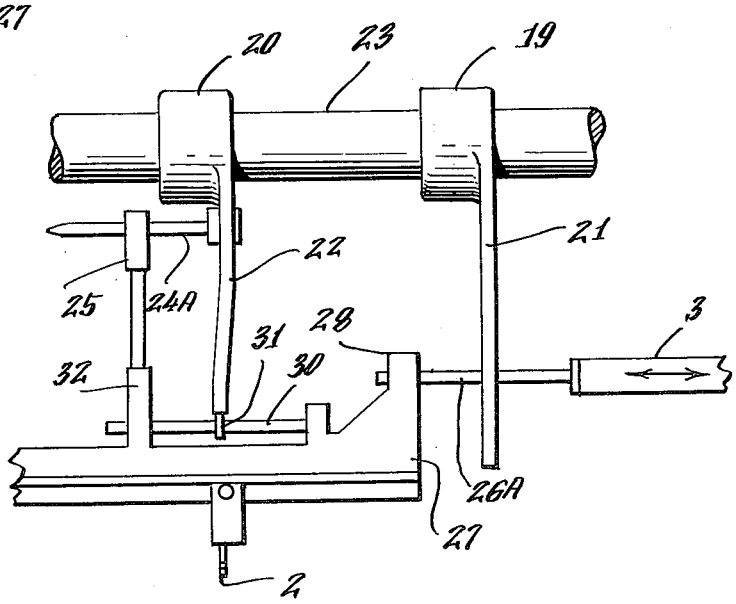
FIG. 3 is a similar diagrammatic showing with elongated pins which permit knitting wider fabrics.

FIGS. 2 and 3 illustrate the provision for knitting somewhat wider fabric. They are also semidiagrammatic but not as fully diagrammatic as FIG. 1 as it is necessary to show some of the parts of the knitting machine to show where the new parts are located.

FIG. 2 illustrates a standard Raschel knitting machine designed with pins of normal length. There are two brackets 21 and 22 which are fastened to the guide bar shaft 23 of the machine, as shown at 19 and 20. Through bracket 21 there extends a pin 26 which is attached to the element 3 which drives the thread guide bar or thread guide bars. This pin 26 fastens into a projection or boss 28 on the thread guide bar. As this is shown in a little more detail than in the purely diagrammatic FIG. 1, the guide bar is designated by the number 27. Similarly, the bracket 22 is provided with a projection 31 which slides on a pin 30 on the thread guide bar 27. The same bracket also carries a pin 24 which slides through the portion 25 of a second boss 32 on the guide bar. This boss also furnishes anchorage for the other end of the pin 30. The limit of motion of the thread guide bar 27 is determined by the length of the pin 26 which determines when the element 3 strikes the bracket 21. Similarly the pin 24 sets a limit to how far the part 25 of the boss 32 can move to the right before striking the bracket 22. It will be noted that the pin 30 is considerably longer than the permissible travel by reason of the pins 24 and 26.

FIG. 3 shows the same arrangement of elements but now pin 24 and pin 26 are quite a lot longer and are designated as **24*a* and 26*a* to bring out that while they are the same kind of element as in FIG. 2 they are not identical but are longer. Now, of course, the length of the pin 30 is what limits the travel of the guide bar 27 to the left just as the length of the pin 26*a* is what limits the amount that the guide bar can move to the left before the rod 3 strikes the bracket 21. Neither FIGS. 2 nor 3 are exactly to scale, and their purpose is to illustrate the change in length of the permissible stroke of the thread guide bar. FIG. 3 requires a very slight and quite inexpensive modification of the Raschel knitting machine, simply the substitution of longer pin 24*a* for the shorter pin 24 in the standard machine. Similarly, the longer pin 26*a* does not require any expensive modifications; in fact may require no modification at all. Ordinarily in the variant of the present invention where longer pins are provided the extra length of the pin 26*a* is provided when the new drive is set up. It is usually preferred to provide the longer pins of FIG. 3** from the start as the additional cost is very small and this permits the wider choice of fabric widths. Of course, if it is desired only to have narrower fabric widths, the lengthening of the pins may be made only when the wider fabric widths are desired.

We claim:

1. In a Raschel warp knitting machine provided with at least one thread guide bar capable of moving in a direction to effect shogging, the improvement which comprises means for driving each of said thread guide bars in directions to effect shogging by a cam and cam follower driven from the main drive of the knitting machine, which means for driving the thread guide bars comprises a first lever and a second lever, the first lever being pivoted at one end, with the other end pivoted to a push rod for the guide bar or bars, said first lever having a centrally located slot with a lockable pivot adjustment which can be moved to various positions in the slot to effect variations of guide bar stroke, a second lever pivoted approximately centrally and being provided with two adjustment slots, one on either side of the central pivot, a link pivoting on the lockable pivot in the slot of the first lever and extending to another lockable pivot in one of the slots of the second lever, and means for driving said second lever comprising a cam, cam follower and a link, said cam being driven in synchronism to the knitting machine drive and said link being pivoted in a lockable pivot movable and lockable in said second slot of said second lever whereby stroke adjustment by moving the lockable and movable pivots in the slots in the first and second levers permits narrow fabrics of adjustable width to be knit, the adjustment in each of the three slots of the first and second levers permitting shogging all the way across each fabric.

2. A Raschel knitter according to claim 1 for knitting narrow fabrics wider than about 1¼ inches which comprises in addition to the cam driven adjustable linkages lengthened pins on the thread guide brackets of the thread guide bar or bars, whereby greater movement of the guide bars is made possible without contacting other elements of the knitting machine.

* * * * *